US006513346B1

(12) United States Patent
Giovanni

(10) Patent No.: US 6,513,346 B1
(45) Date of Patent: Feb. 4, 2003

(54) METHOD OF FORMING A PIECE OF FLEXIBLE LINEAR JEWELRY, AND JEWELRY PRODUCED THEREBY

(75) Inventor: Lazzeri Giovanni, Arezzo (IT)

(73) Assignee: Uno a Erre Italia S.p.A., Arezzo (IT)

( * ) Notice: Subject to any disclaimer, the term of this patent is extended or adjusted under 35 U.S.C. 154(b) by 0 days.

(21) Appl. No.: 09/719,373

(22) PCT Filed: Jun. 4, 1999

(86) PCT No.: PCT/IT99/00162

§ 371 (c)(1),
(2), (4) Date: Dec. 8, 2000

(87) PCT Pub. No.: WO99/63853

PCT Pub. Date: Dec. 16, 1999

(30) Foreign Application Priority Data

Jun. 10, 1998 (IT) ..... FI98A0140

(51) Int. Cl.[7] ..... A44C 5/00

(52) U.S. Cl. ..... 63/3; 63/4; 63/5.2; 29/896.41; 59/79.2

(58) Field of Search ..... 63/3, 5.1, 5.2, 63/11, 15.5, 15.7; 24/20 R; 29/896.9, 896.41, 896.411; 59/79.1, 79.2, 83

(56) References Cited

U.S. PATENT DOCUMENTS

| | | | | | |
|---|---|---|---|---|---|
| 4,627,231 | A | * | 12/1986 | Kiuchi | 59/80 |
| 5,425,228 | A | * | 6/1995 | Hillel | 59/35.1 |
| 5,437,149 | A | * | 8/1995 | Strobel | 59/80 |
| 5,471,830 | A | * | 12/1995 | Gonzales | 59/3 |
| 5,526,639 | A | * | 6/1996 | Gonzales | 59/29 |
| 5,537,812 | A | * | 7/1996 | Rozenwasser | 59/3 |
| 5,626,012 | A | * | 5/1997 | Fabbro | 59/35.1 |
| 5,682,736 | A | * | 11/1997 | Chia et al. | 59/35.1 |
| 5,966,922 | A | * | 10/1999 | Cossio | 59/35.1 |
| 6,338,238 | B1 | * | 1/2002 | Kahan | 59/35.1 |

FOREIGN PATENT DOCUMENTS

| | | | | |
|---|---|---|---|---|
| DE | 26 40 819 A | | 3/1977 | |
| GB | 06181 A | | 12/1912 | |
| GB | 1539830 A | | 1/1979 | |
| SE | WO 02/38307 | * | 5/2002 | B21L/3/00 |

OTHER PUBLICATIONS

International Preliminary Examination Report, Jul. 6, 2000.

* cited by examiner

*Primary Examiner*—Robert J. Sandy
*Assistant Examiner*—Andre L. Jackson
(74) *Attorney, Agent, or Firm*—Morgan, Lewis & Bockius LLP

(57) ABSTRACT

Starting with an article of the so-called "gas pipe" type which is formed from two concatenated spiral components (1, 3) and is deformed into a noncircular configuration, the article is cut lengthwise (7) to cut the turns of the two components, which remain connected without relative movements.

9 Claims, 2 Drawing Sheets

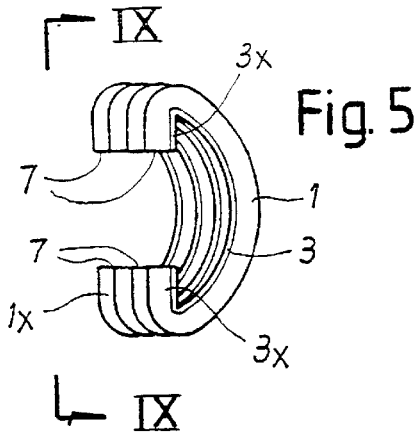
Fig. 5
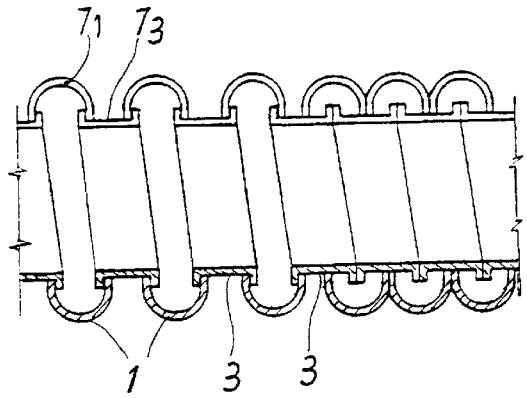
Fig. 6
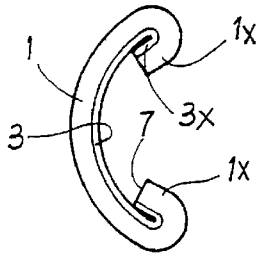
Fig. 7
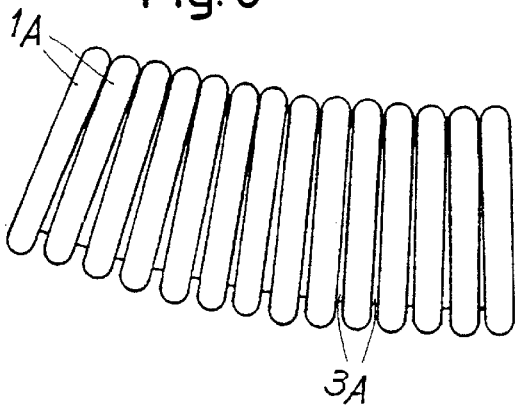
Fig. 8
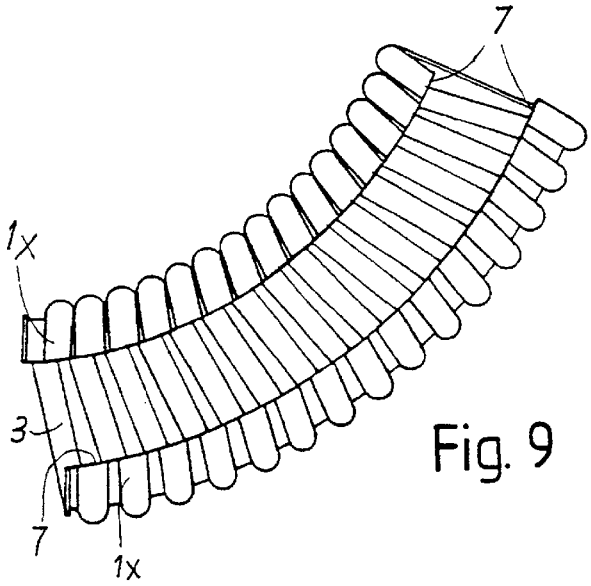
Fig. 9
Fig. 10
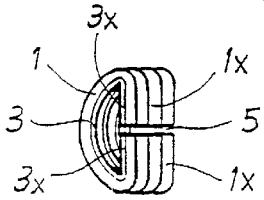
Fig. 11
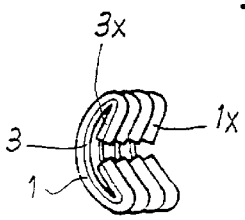

METHOD OF FORMING A PIECE OF FLEXIBLE LINEAR JEWELRY, AND JEWELRY PRODUCED THEREBY

DESCRIPTION

The prior art includes jewelry—usually in the form of necklaces or bracelets or the like—composed of two helically deformed components concatenated together in such a way that one of them is on the outside and highly visible (in an annular configuration) while the other is internal and therefore less visible. These structures are of the so-called "gas pipe" type. The configuration may be circular in outline but is more frequently of a flattened outline, the helical turns being deformed to assume a cross section more consonant with the function of the jewelry, the final cross section may be a circular segment with a base.

In the abovementioned conditions, which are known e.g. from C.B.A. 1,593,830, the jewelry has limited flexibility, which is not very satisfactory in terms of requirements of deformability, which are inadequate.

The principal object of the invention is to provide a more flexible and therefore "softer" piece of jewelry than has been obtained in the past, and the possibility of lengthening it without increasing the number of turns. Another object is to obtain an improved appearance for the same linear weight, or indeed for less weight and always with enhanced flexibility. These and other objects and advantages will become clear on reading the text that follows.

An initial subject of the invention is a method of forming a piece of flexible linear jewelry, starting with an article of the so-called "gas pipe" type which is formed from two concatenated spiral components and is deformed into a noncircular configuration; according to the invention the article is cut lengthwise to cut the turns of said two components, which turns remain connected without relative movements; in this way greater flexibility is provided than that provided by the starting material.

In an advantageous development of the invention, two lengthwise incisions are made a distance apart and the segments of turn situated between the two incisions are removed. This achieves a further advantage of lower weight for equal aesthetic effect, in addition to greater flexibility.

In a piece of jewelry which is deformed with flattening and in particular with a section having limited curvature to the point of being almost planar, said incision or incisions may be made in said section.

For greater refinement, and also for greater stability and comfort, the ends of the cut turns may be bent in.

Another subject of the invention is a piece of linear jewelry initially formed with two helical components concatenated and deformed into a noncircular configuration; according to the invention in said piece of jewelry the turns of each of the two components are interrupted by at least one cut, the ends of the interrupted turns of the two components being substantially aligned with each other.

In practice and advantageously, the turns of the two components may lack a segment from a section having reduced or no curvature of the turns, the ends of the interrupted turns being substantially aligned in the lengthwise direction.

The ends of the interrupted turns may be bent in.

A clearer understanding of the invention will be gained from the description and attached drawing, which latter shows a practical, non-restrictive example of the invention. In the drawing:

FIGS. 4, 5 and 6 show views similar to FIGS. 1, 2 and 3 of the piece of jewelry made in accordance with the invention;

FIG. 7 shows a cross section similar to that of FIG. 5, illustrating a further modification of the piece of jewelry according to the invention;

FIGS. 8 and 9 show a view taken on VIII—VIII as marked in FIG. 2 and on IX—IX as marked in FIG. 5, in the curved configurations of the jewelry in the conventional configuration and of the jewelry according to the invention, to illustrate their different capacities for curvature;

FIGS. 10 and 11 show views similar to FIGS. 5 and 7 of an alternative embodiment of the invention.

Figure 1:
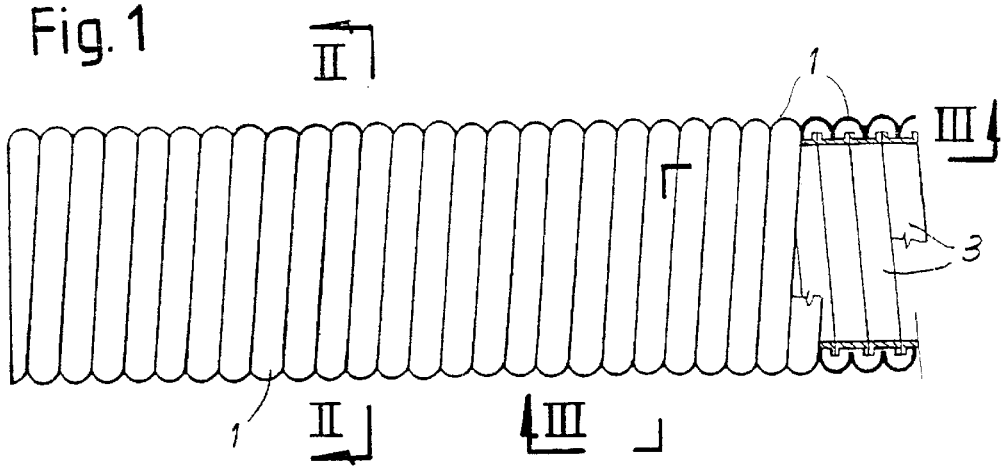
FIGS. 1, 2 and 3 show in a partly sectioned external view, in a transverse section on II—II as marked in FIG. 1 and in a local section on III—III as marked in FIG. 1, a conventional piece of jewelry of the so-called "gas pipe" type having the cross section of a circular segment with a base.
Figure 2:
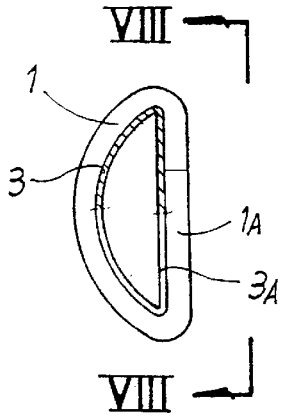
Figure 3:
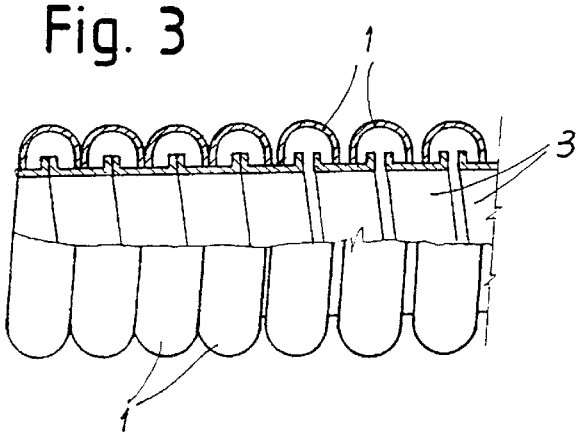

As illustrated in FIGS. 1–3, a piece of jewelry, such as a necklace or bracelet—of the so-called "gas pipe" type is composed of two profiled components 1 and 3, external and internal respectively, which are spiral-shaped and which engage with each other in their successive turns, so as to interlock mutually; in this way the two components 1 and 3 are held together but are capable of limited movements as can be seen by the difference between the configuration shown on the left and right when viewing FIG. 3, because of the possibility of limited elastic flexing of the two components. This allows a limited curvature of the jewelry article owing to the ability to execute slight angular movement between the various turns. In some particular versions, the tubular so-called "gas pipe" jewelry, rather than having a more or less circular cross section of the turns, exhibits deformation of the two coiled components, so that the overall cross section of the article is flattened, for example—and in particular, as clearly visible in FIG. 2—with an outline in the form of a circular segment with a base, comprising one section, consisting of the sections 1A and 3A of the two components 1, 3 that is more or less straight or of very limited curvature; even in this version, the deformation, i.e. the curvature, can take place either in a plane corresponding to that of the plane of the drawing of FIG. 1 or in a plane perpendicular to that of FIG. 1. The article and a piece of jewelry produced from this article, of known type, therefore presents a defect due to the limited capacity of the article for curvature, when in fact it is preferable for the jewelry to be much more supply and pliably malleable, that is "softer", with preferably much smaller radii of curvature, that is with much sharper curvature than that obtained with articles of the known type of FIGS. 1–3.

Figure 4:
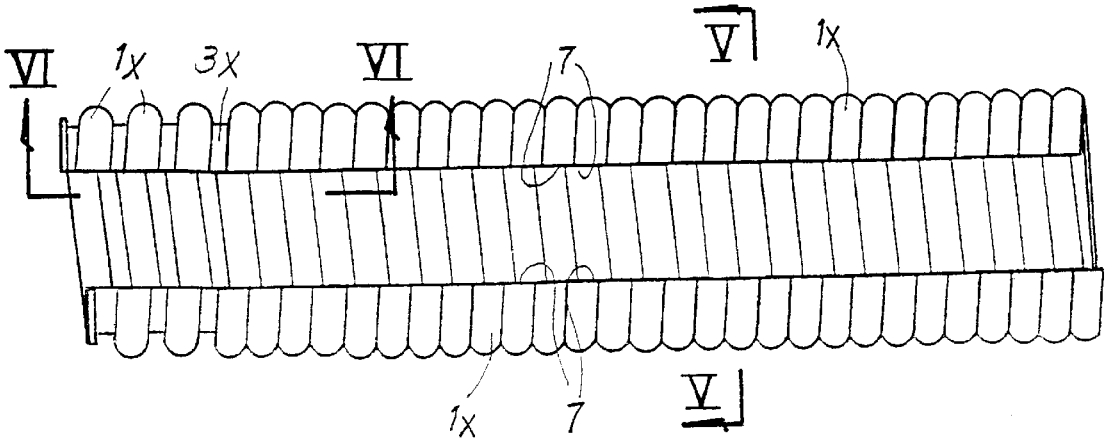

To reach this object, according to the invention, in an initial article having noncircular turns (or even turns of the cross section corresponding to that of FIG. 2), the turns of each of the two helical components are interrupted by at least one lengthwise cut; in an article having the cross section shown in FIG. 2 the cut is made advantageously in the sections 1A and 3A which are straight or at any rate of limited curvature, generally convex toward the exterior. A single lengthwise cut can be made as marked 5 in FIG. 10, or two separate parallel lengthwise cuts can be made as seen in FIGS. 4 and 5. This gives a piece of jewelry in which the turns remain connected to each other to prevent relative angular movement but with truncated ends as marked 5 in FIG. 10 and 7 in FIGS. 4 and 5; in FIG. 6 the cut ends 7 are differentiated as indicated by $\mathbf{7}_1$ and $\mathbf{7}_3$, referring to the way in which component 1 and component 3 are cut. The cuts 7, that is $7_1$ and $7_3$, remain essentially coplanar because the turns interrupted by the cuts are unable to make angular movements owing to the non-circumferential form of the turns themselves. In the case of FIGS. 5–7 and FIG. 9 there are two parallel cuts 7, clearly visible in FIGS. 4 and 5, and the segments of the turns 1 and 3 situated between the two cuts 7 are removed, which reduces the weight of the jewelry without affecting its apparent dimensions, compared with the conventional piece in which the turns are complete as shown in FIGS. 1–3. In FIG. 10 the single lengthwise cut 5 rules out the possibility of removing a segment of turn from either of the components such as 1 and 3. The cut and now independent turns of each of the components 1 and 3 can be separated from each other as far as permitted by the connection represented by the turns of the other component, which means that it is possible to extend the article, without the elastic flexing of the helical components 1 and 3, and a greater curvature of the article in the various planes is also possible.

As can be seen in FIGS. 7 and 10 in particular, the truncated ends marked 1X and 3X can be slightly bent in, i.e. toward the concave part of the respective turns, to give a better finish than an unbent cut as shown in FIGS. 5 and 10. Obviously, whichever solution is adopted, the cuts 7 and therefore the ends 1X and 3X can be suitably rounded at the cut edges, to eliminate excessively angular cut parts of jewelry.

Whatever the configuration is of the article modified in accordance with the invention and as illustrated in FIGS. 4–7 and 9–11, it is much more flexible and therefore capable of much greater curvature both in the plane corresponding to the plane of the drawing of FIGS. 1 and 4 and of FIGS. 8 and 9, and in a plane perpendicular to that of said FIGS. 1, 4, 8 and 9. This therefore avoids the disadvantages mentioned above of jewelry constructed with the so-called "gas pipe" of FIGS. 1 and 3 (however the turns are configured), thus giving a piece of jewelry that is decidedly more desirable from the esthetic and even functional points of view. The article can be pulled out longer than the starting article of FIGS. 1–3 which is tied to the lengthwise elastic flexing of the two helical components 1 and 3. When two parallel cuts such as 7 in FIGS. 4–6 and 9 are used, with consequent removal of the segments corresponding to the sections of turns situated between the two cuts 7, the article also becomes lighter for equal length and without altering the apparent dimensions when looking toward the more curved side of the cross section of the piece of jewelry, i.e. the side without the cuts 7. The advantage achieved by this is both functional and economical and is due to the reduced weight, which is important both for the use of the jewelry itself and also for the saving in terms of precious metals with which such jewelry is usually made. It will be clear that the configuration of the cross section of the jewelry can be changed from those illustrated in the drawing, provided however the turns have a noncircular configuration, to prevent angular movement between the interrupted turns, as such angular movement might otherwise allow disassembly of the constituent parts of the turns, separated as they are by the cuts, or at least to prevent binding of the various portions of adjacent turns, with a return to the characteristics of the structures of the "gas pipe" without the lengthwise cuts of the invention.

It will be understood that the drawing shows only an example purely as a practical demonstration of the invention, which latter can be varied in its shapes and arrangements without however departing from the scope of the concept on which the invention is based. The presence of any reference numbers in the appended claims is for the purpose of facilitating the reading of the claims with reference to the description and drawing, and does not limit the scope of protection represented by the claims.

The cross section of each of the components 1 and 3 may of course be different to that shown in the drawing.

What is claimed is:

1. An article of flexible linear jewelry fabricated from two helical components (1, 3) concatenated and deformed into a noncircular configuration, each of the two helical components including a plurality of adjacently-connected helical turns, characterized in that the turns of each of the two helical components (1, 3) are interrupted by at least one cut (5,7) so as to provide a plurality of interrupted turns having end portions (1X and 3X), the end portions (1X, 3X) of the interrupted turns of the two helical components being at least approximately aligned in a lengthwise direction.

2. The article of jewelry as set forth in claim 1, further characterized in that the end portions (1X, 3X) of the interrupted turns are bent inwardly.

3. The article of jewelry as set forth in claim 1, further characterized in that the turns of the two components (1, 3) lack a segment from a section having reduced or no curvature of the turns, the end portions (1X, 3X) of the interrupted turns being at least approximately aligned in a lengthwise direction.

4. An article of jewelry as set forth in claim 3, further characterized in that the end portions (1X, 3X) of the interrupted turns are bent inwardly.

5. A method of forming a piece of flexible linearjewelry from two concatenated spiral components, each component including a plurality of adjacently-connected helical turns, the method including the steps of:

(a) deforming the concatenated spiral components into a noncircular configuration, and (b) cutting the concatenated spiral components lengthwise (5, 7) to interrupt the turns of each of said two components (1, 3), which turns remain connected without relative angular movements.

6. The method of claim 5, wherein the step of deforming includes the step of flattening the jewelry with a section (1A, 3A) of limited curvature such that the section is almost planar, and wherein the step of cutting is performed by making an incision (5) or incisions (7, 7) in said section.

7. The method of claim 5, further including the step of bending the ends (1X, 3X) of the cut turns inwardly.

8. The method of claim 5, wherein the step of cutting is performed by making two lengthwise incisions (7, 7) a distance apart and a portion of turns situated between the two incisions is removed.

9. The method of claim 8, further including the step of flattening the jewelry to include at least a section (1A, 3A) of limited curvature to the point of being almost planar, and characterized in that the step of cutting includes making an incision (5) or incisions (7, 7) in the section.

* * * * *